US005775240A

United States Patent [19]

Hara et al.

[11] Patent Number: 5,775,240

[45] Date of Patent: Jul. 7, 1998

[54] SEWING MACHINE CAPABLE OF EMBROIDERY STITCHING, AND EMBROIDERY DATA PRODUCING DEVICE THEREFOR

[75] Inventors: Kazumasa Hara; Hidechika Kuramoto; Mikio Koike; Haruhiko Tanaka; Akiyoshi Sasano; Shinichi Fukada, all of Hachioji, Japan

[73] Assignee: Janome Sewing Machine Co., Ltd. Tokyo, Japan

[21] Appl. No.: 760,197

[22] Filed: Dec. 4, 1996

[30] Foreign Application Priority Data

Dec. 5, 1995 [JP] Japan ..... 7-339849

[51] Int. Cl.[6] ..... D05B 21/00; D05C 9/02

[52] U.S. Cl. ..... 112/102.5; 112/458

[58] Field of Search ..... 112/102.5, 470.06, 112/454, 456, 458, 445, 475.19

[56] References Cited

U.S. PATENT DOCUMENTS

| | | | |
|---|---|---|---|
| 4,622,907 | 11/1986 | Kimura | 112/102.5 |
| 4,781,130 | 11/1988 | Badowski | 112/454 X |
| 5,313,902 | 5/1994 | Shoji | 112/454 |
| 5,427,044 | 6/1995 | Hirabayashi | 112/458 X |

*Primary Examiner*—Peter Nerbun

*Attorney, Agent, or Firm*—Michael Striker

[57] ABSTRACT

A sewing machine capable of embroidery stitching and a embroidery data producing device for the machine are formed so that optionally selectable data are provided for forming the stitches of unit patterns to be embroidered, for arranging the unit pattern in series along a linear outline forming a looped pattern, for setting the size and the number of the unit patterns, the space between the unit patterns in an arrangement thereof and the size of the looped pattern, and stitch forming means is operated under control of said given data to form the stitches of the unit patterns arranged along the linear outline.

19 Claims, 9 Drawing Sheets

FIG.8D X-axis

FIG.8E Y-axis

SEWING MACHINE CAPABLE OF EMBROIDERY STITCHING, AND EMBROIDERY DATA PRODUCING DEVICE THEREFOR

BACKGROUND OF THE INVENTION

The present invention relates to a sewing machine capable of embroidery stitching and to an embroidery data producing device for it.

A conventional embroidery stitching sewing machine is generally provided with predetermined stitch forming data of patterns to be embroidered so that a machine user may optionally select any of the predetermined patterns. However with a wide spread application of embroidery stitching by means of a sewing machine, the machine user has come to desire a sewing machine capable of embroidery stitching which will provide a wider selection of patterns which may be optionally varied or modified as desired in accordance with the originality of the machine user. In this respect, the conventional embroidery stitching sewing machine fails to satisfy the demand of the machine user.

SUMMARY OF THE INVENTION

Accordingly, it is an object of present invention to provide a sewing machine capable of embroidery stitching, as well as to provide an embroidery data producing device for the sewing machine which avoids the disadvantages of the prior art.

In keeping with these objects and with others which will become apparent hereinafter, one feature of the present invention resides, briefly stated, in a sewing machine capable of embroidery stitching, which has a means for giving data for forming the stitches of unit patterns. The data giving means may include a memory having stitch forming data stored therein and a means for reading out the stitch forming data from the memory, or an image sensor for inputting images or CAD for producing the pattern data. The unit patterns mentioned herein includes a plurality of different single patterns including ornamental patterns, graphic patterns, characters, symbols or lines which may be the objects of embroidery stitching.

The sewing machine of the invention further has a means for giving data for arranging the unit patterns. The pattern arrangement data represents a linear outline forming a looped pattern along which the pattern is arranged in series. The pattern arrangement outline or configuration may be predetermined or may be designed by the machine user or may be inputted by means of the image reader or CAD.

The sewing machine of the invention further has an embroidery stitching means which is operated under control of the given data to form the stitches of the unit patterns which are arranged around the linear outline, that is, on the linear outline, inside or outside of the linear outline or at random with respect to the linear outline as desired.

The size and the number of the unit pattern may be optionally selected. Further the space between the unit patterns may be optionally selected. The space may be set with a minus value to overlap the unit patterns in arrangement thereof. The size of the arranged shape of unit patterns (size of linear outline) is automatically or optionally adjusted in dependence upon the size and the space of the unit patterns.

The size of the pattern arrangement (linear outline) and of the unit pattern and the number and the space of the unit patterns are all interconnected with each other. If some of the attributes are set by the machine user, the other attributes may be automatically decided by a predetermined algorithm. Further with respect to the number of the unit pattern and the size of the pattern arrangement, the setting priority may be predetermined or may be optionally decided by the machine user.

All the attributes of the pattern arrangement (linear outline) and the unit pattern may be predetermined, or may be used to produce several samples of the unit patterns arranged in various modes so as to be optionally selected by the machine user.

The functions as mentioned above may be incorporated in the sewing machine or may be provided independently of the sewing machine as an embroidery stitch data producing device.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 8(A)–(E) are representations of a unit pattern arranged in series by way of example along the linear outline of a looped pattern with different orientations given to the unit patterns in the respective groups;

DESCRIPTION OF PREFERRED EMBODIMENTS

Figure 1:
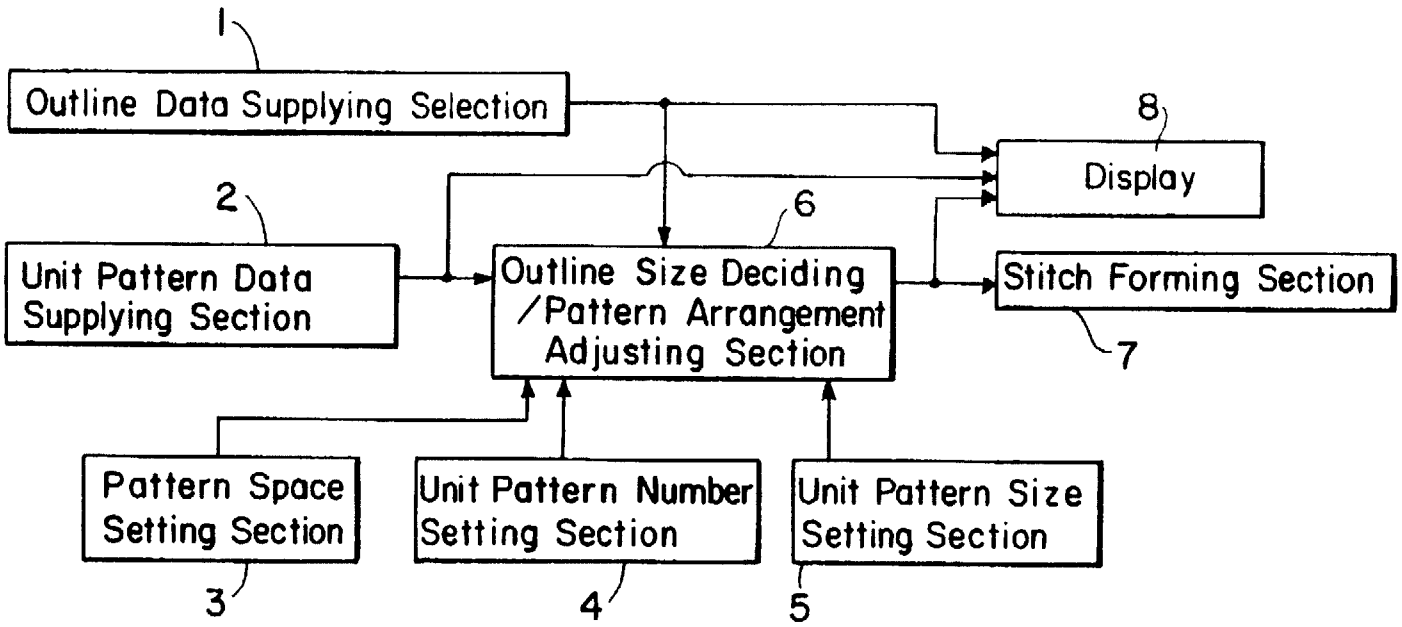
FIG. 1 is a block diagram showing the substantial functions of the invention by way of example.
Figure 5A:
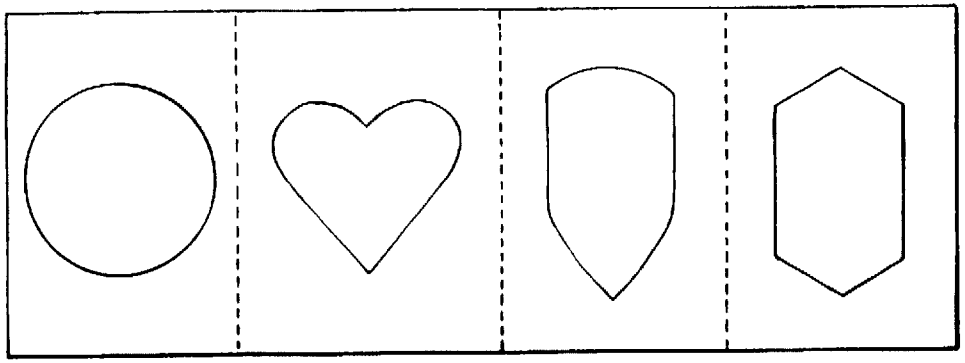
FIG. 5(A) is a representation of looped patterns having different linear outlines respectively shown by way of example.

A sewing machine capable of embroidery stitching in accordance with the present invention as shown in FIG. 1 has an outline data supplying section provided to supply the data for representing a linear outline of a pattern. It includes a memory storing therein the outline data, an image reader for reading original patterns to reduce the same to signals, CAD or a computer, for example, to give the outline data representing linear outlines forming the different patterns such as a circle, a heart shape, a shield, a diaper and so on as shown in FIG. 5(A), which may be optionally selected by the user of the sewing machine. The other patterns may be selectively inputted by use of the image reader. The data supplied from the outline data supplying section 1 is indicated in a display 8 and is simultaneously transmitted to an outline size deciding/pattern arrangement adjusting section 6.

The inventive sewing machine further has a unit pattern data supplying section 2 is provided to supply the data for representing a unit pattern. The unit pattern data supplying section 2 includes a memory storing pattern data therein or other pattern data producing means including the image reader for reading optionally designed ornamental patterns, characters, symbols and/or color information.

Figure 5B:
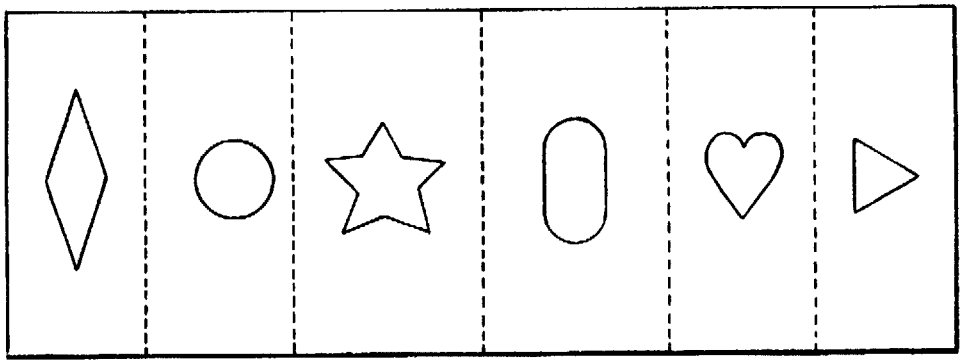
FIG. 5(B) is a representation of unit patterns shown by way of example having different shapes respectively to be embroidered.

FIG. 5(B) shows, by way of example, the unit patterns such as a diaper, a circle, a star, an elongated circle, a heart shape and a triangle which are stored in the unit pattern data supplying section 2 and may be optionally selected by the user for embroidering the same. The data supplied from the unit pattern data supplying section 2 is indicated in the display 8 and is simultaneously transmitted to the outline size deciding/pattern arrangement adjusting section 6.

The size and the number of the unit pattern and the space between the unit patterns may be optionally set up at a unit pattern size setting section 5, a unit pattern number setting section 4 and a pattern space setting section 3 respectively, or may be provided with predetermined initial value respectively which is variable in response to the optional selection of the user.

Figure 6A:
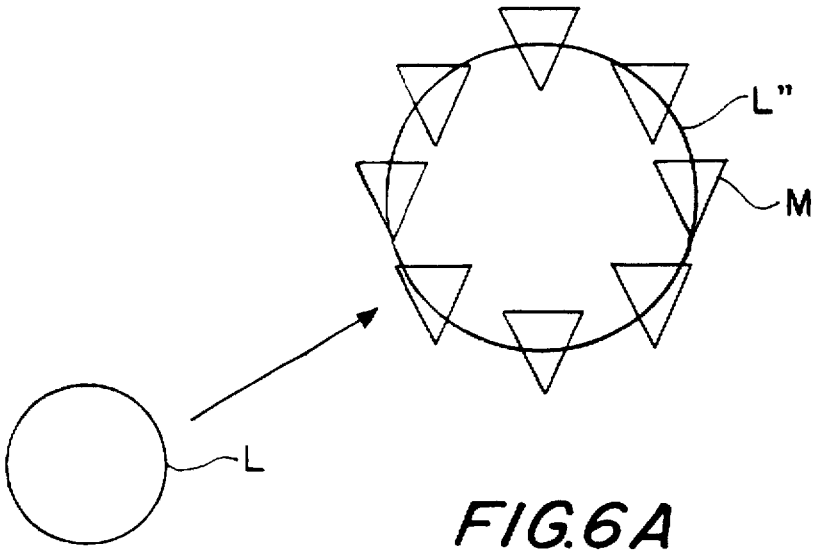
FIG. 6 is a representation of a unit pattern arranged in series by way of example along the linear outline of a looped pattern shown in different sizes.
Figure 6B:
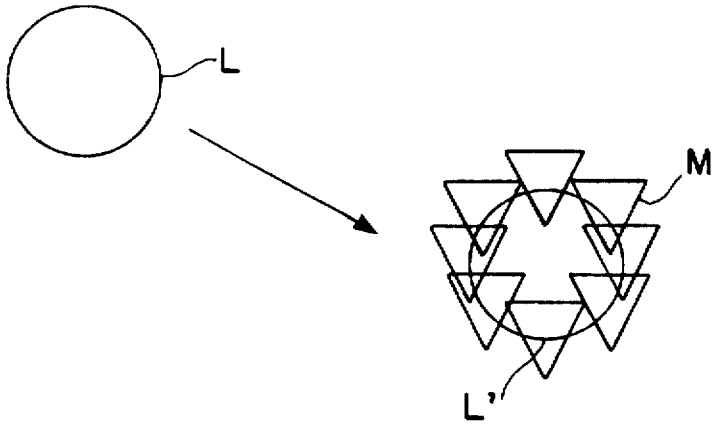

The outline size deciding/pattern arrangement adjusting section 6 will operate to decide the size of the unit patterns and adjust the arrangement of the unit pattern in accordance with the instructions given from the outline data supplying section 1, the unit pattern data supplying section 2, the pattern space setting section 3, the unit pattern number setting section 4 and the unit pattern size setting section 5. As shown in FIG. 6(A), by way of example, one linear outline or configuration L forming adopted pattern such as a circle and an optional number (for example, 8 pieces) of unit patterns M in the shape of triangle may be selected with the optional size and arrangement being designated thereto while the space between the patterns M is set with a standard value as shown. In this case when the machine user operates the pattern space setting section 3 to set the space between the patterns M with a minus value so as to overlap the patterns, the outline size deciding/pattern arrangement adjusting section 6 will operate to reduce the size of the near outline or configuration L accordingly, as shown in FIG. 6(B).

In this way, according to the invention, the outline size deciding/pattern arrangement adjusting section 6 is designed to automatically change the size and arrangement of the previously selected and set up patterns in accordance with the optional selection of the machine user. The outline size deciding/pattern arrangement adjusting section 6 transmits the data of so arranged and adjusted unit patterns to a stitch forming section 7 for actually stitching the patterns. The linear outline L is normally not stitched, but may be stitched when desired.

Figure 7A:
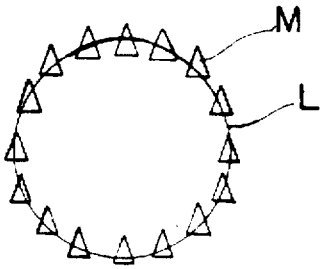
FIGS. 7(A)–(D) are representations of a unit pattern arranged in series by way of example along the linear outline of a looped pattern at different positions with respect to the linear outline.
Figure 7B:
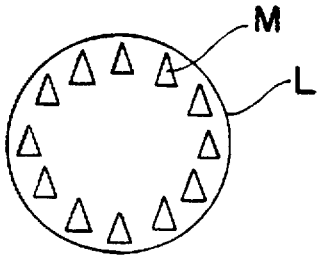
Figure 7C:
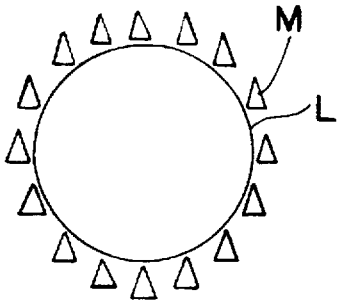
Figure 7D:
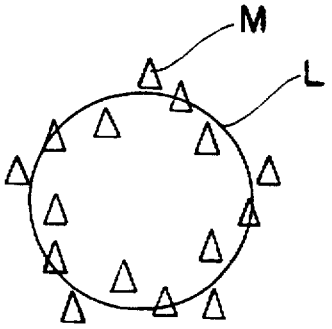

FIG. 6 shows the unit patterns M arranged on the linear outline L. However the unit patterns M may be arranged inside or outside of the linear outline L as shown in FIG. 7(B) or FIG. 7(C), or in optional combination thereof with respect to the linear outline L as shown in FIG. 7(D).

Figure 8A:
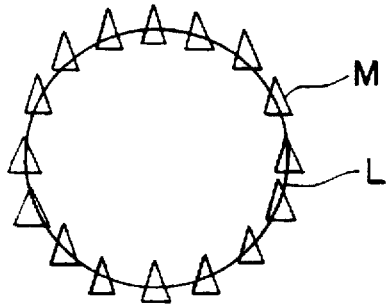
Figure 8B:
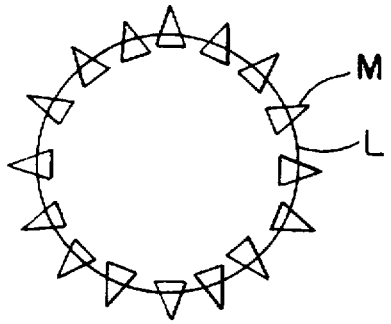
Figure 8C:
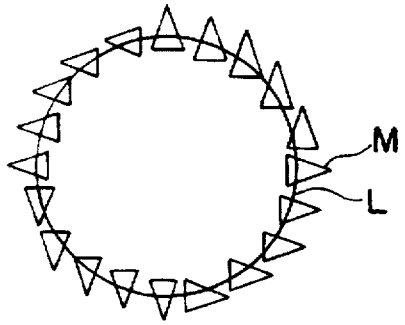
Figure 8C:
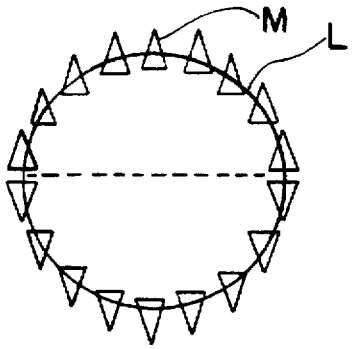
Figure 8C:
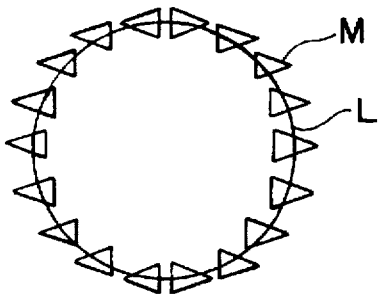

FIG. 6 shows one sort of unit patterns M arranged in series. However it is possible to arrange a plurality of different unit patterns or to form a sentence with arrangement of characters. In FIG. 6, the unit patterns M are oriented in a same direction. However it is possible to change the orientation of the unit patterns as shown in FIG. 8. FIG. 8(A) shows the unit patterns M oriented in a same direction. FIG. 8(B) shows the unit patterns M oriented in the radial directions. FIG. 8(C) (shows the unit patterns M oriented in different directions in the angular ranges of 90°. FIGS. 8(D) and (E) shows the unit patterns M oriented in the opposite directions in reference to X and Y axes respectively.

Figure 9A:
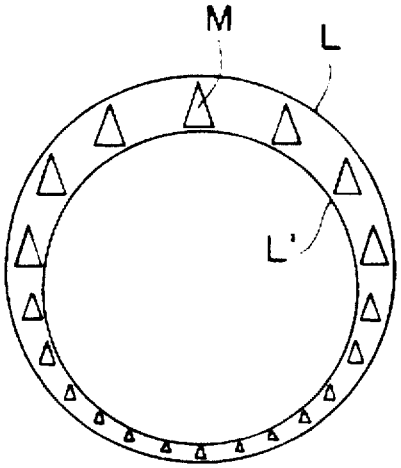
FIG. 9 is a representation of varied combinations of a looped pattern and a unit pattern which is arranged in series with respect to the looped pattern.
Figure 9B:
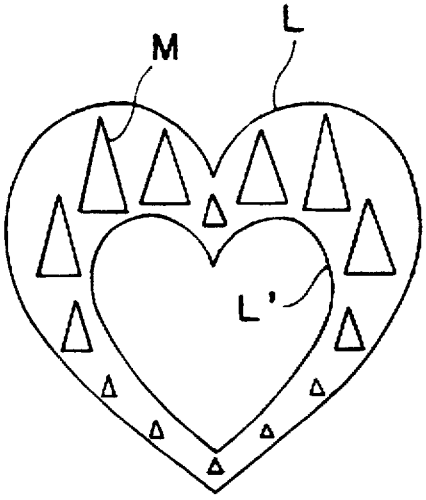
Figure 10A:
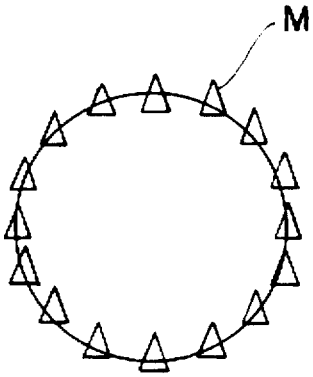
FIG. 10 is a representation of a unit pattern arranged in series along a looped pattern with the unit patterns being inverted from white to black or vice versa.
Figure 10B:
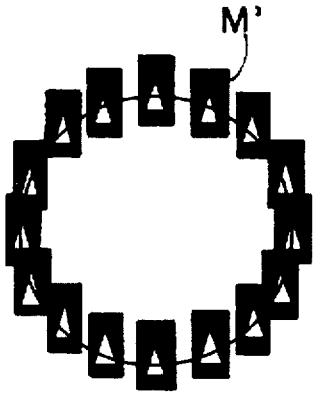

The data so decided and adjusted at the outline size deciding/pattern arrangement section 6 is transmitted to the display 8 and indicated therein in the so decided and adjusted image of unit patterns M. A plurality of linear outlines L, L' may be used to provide an optional area therebetween in which the unit patterns M are arranged as shown in FIG. 9. With further modifications, the embroidery patterns may be varied in many ways. For example, the unit patterns M may be inverted between black and white as shown in FIG. 10.

Figure 2:
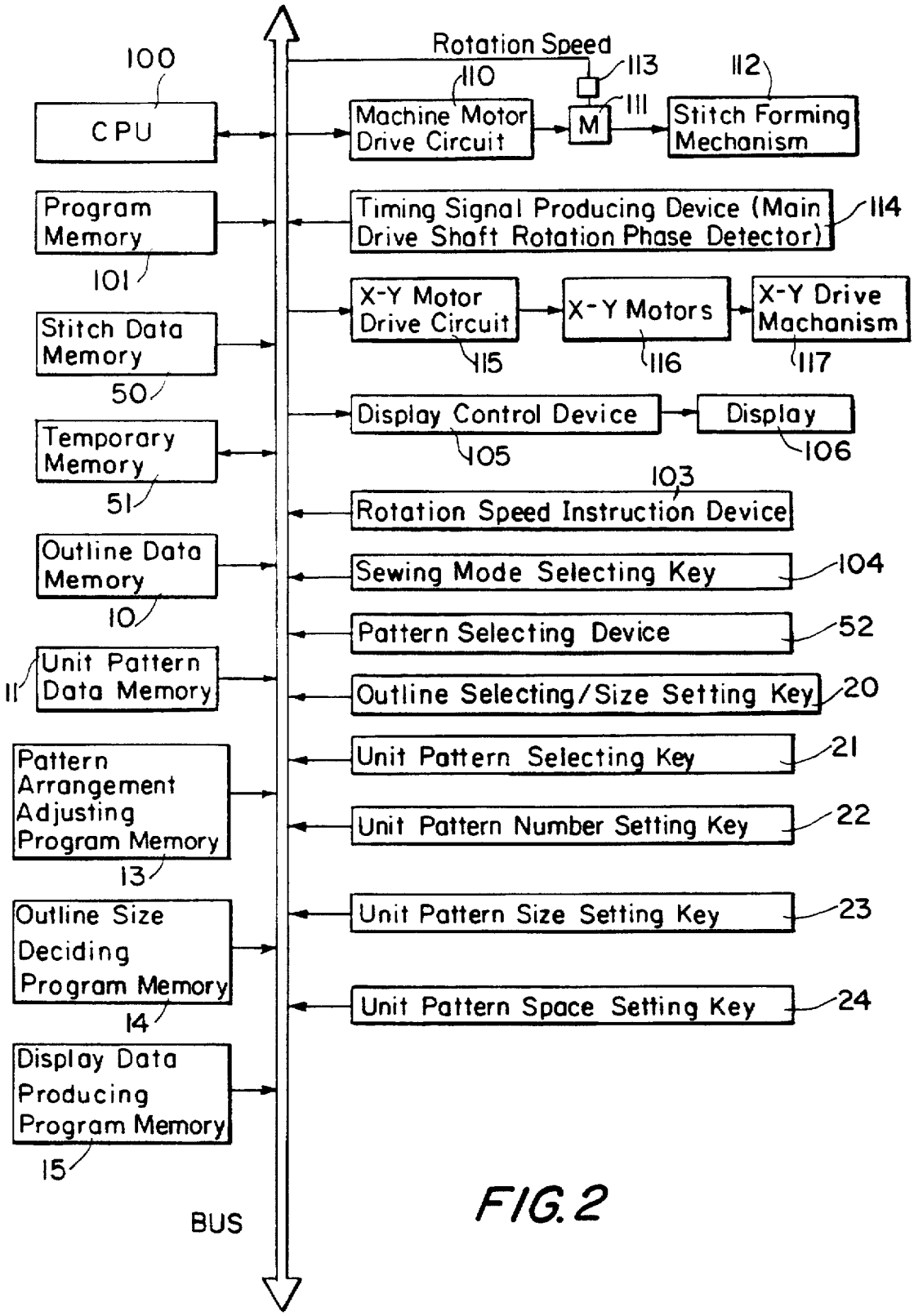
FIG. 2 is a block diagram showing the structure of the invention with a computer being incorporated therein by way of example.
Figure 3:
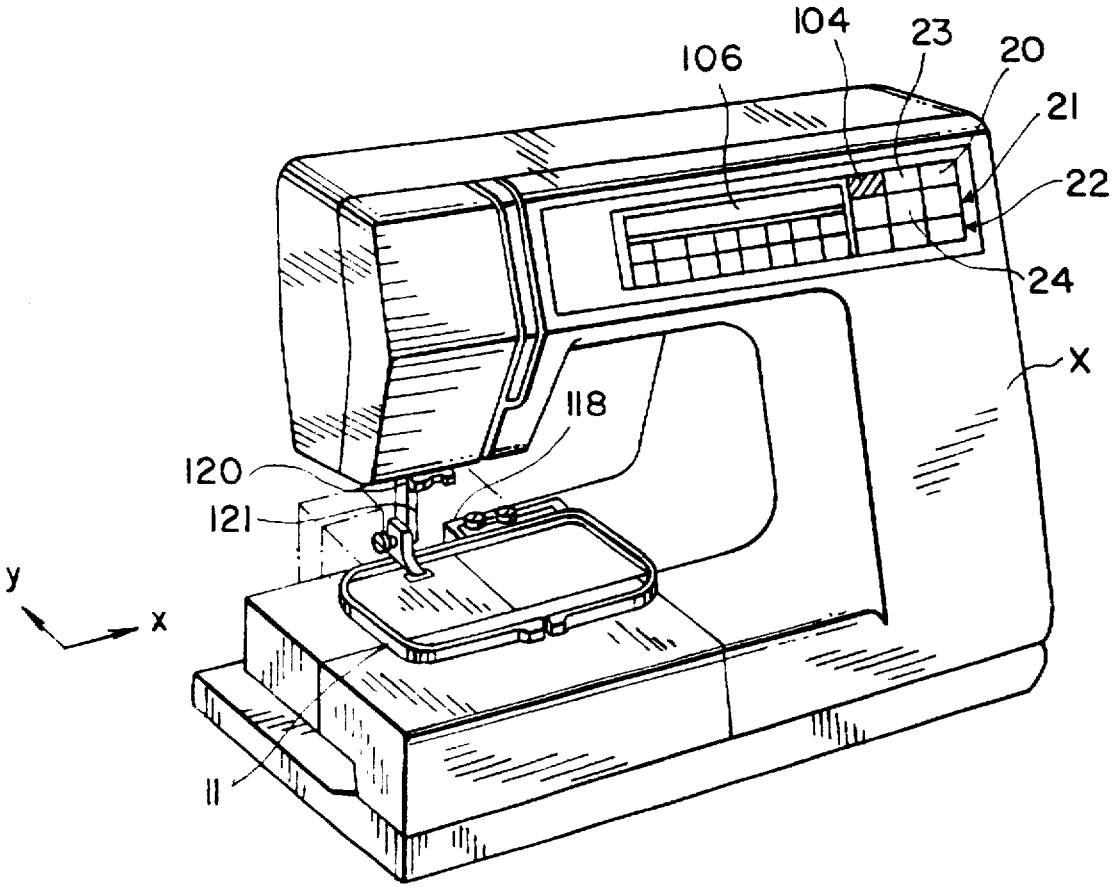
FIG. 3 is a perspective view of a sewing machine incorporated with the invention.

The invention will now be described in reference to FIG. 2 showing a block diagram substantially representing the structure of the invention including a microcomputer and in reference to FIG. 3 showing a sewing machine incorporated with the invention.

In FIG. 3, the sewing machine in accordance with the present invention has a machine housing X which has a carriage 118 provided adjacent to a sewing range thereof. An embroidery frame 119 is detachably attached to the carriage 118. The sewing machine has a vertically reciprocable needle bar 120 and a needle 121 fixed to the lower end of the needle bar 120. The embroidery frame 119 has a cloth extended therein and is moved under with respect to the vertically reciprocating needle by the carriage 118 which is driven in the x-y directions, so that the embroidery stitches may be formed on the cloth held by the embroidery frame 119. The embroidery stitching operation may be selected by operating an embroidery stitching mode selecting key 104. Besides the embroidery stitching, the sewing machine has the ordinary stitching mode for carrying out the ordinary stitching operation by means of the vertically reciprocating needle 121 and the cloth feeding movement given to a cloth by feed dog (not shown). Operation of the mode selecting key 104 will make it possible to select the outline stitching operation on the basis of the data stored in an outline data memory 10 and the data stored in a unit pattern data memory 11.

CPU 100 will operate to control the sewing machine in accordance with the program stored in a program memory 101. A rotation speed designating device 103 including a foot operated speed controller is operated to control a machine motor drive circuit 110, and thereby to designate the rotation speed of a machine 111 which will operate a stitching forming mechanism 112 with the designated stitching speed. The stitch forming mechanism 112 includes the needle bar 120, the needle 121 and the feed dog (not shown) as shown in FIG. 3. The rotation number of the machine motor 111 is detected by a machine motor rotation detector 113 and is fed back to the CPU 100 so as to be used for controlling the rotation speed of the machine motor 111.

The sewing machine in accordance with the present invention is, in addition to the machine motor drive circuit 110, provided with an X-Y motor drive circuit 115, X-Y drive motors 116 and an X-Y drive mechanism 117 in order to carry out the embroidery stitching operation on th basis of the stitch data which is stored in a stitch data memory 50 and read out by operation of a pattern selecting device 52 including pattern selecting keys. The X-Y drive mechanism 117 includes the carraige 118 and the embroidery frame 119 as shown in FIG. 3, wherein the cloth held by the embroidery frame 119 is moved in the X-Y directions by the carraige 118 relative to the vertically reciprocating needle 121 so that the embroidery stitches may be formed on the cloth.

A timing signal producing device 114 is provided to detect particular rotation phases of a main drive shaft of the sewing machine thereby to detect the upper and lower movements of the needle 121 in order to take a timing between the vertically reciprocating needle 121 and the X-Y motor drive circuit 115. The CPU 100 is responsive to the timing signals to control the X-Y motor drive circuit 115.

The embroidery stitching mode and the ordinary stitching mode are optionally selected by operation of the mode selecting key 104 which is provided on a front face of the machine housing X as shown in FIG. 3. The machine housing X further has a display 106 provided on the front face thereof which corresponds to the display 8 as shown in FIG. 1. The display 106 will make various indications thereon in accordance with the instructions supplied thereto from the CPU 100 through an indication control device 105.

When the outline stitching operation is selected by operation of the mode selecting key 104, the CPU 100 reads the outline L stored in the outline data memory 10 and the unit pattern M stored N. the unit data pattern memory 11 and indicates the outline L and the unit pattern M in the display 106 in accordance with a program stored in a display data producing program memory 15. The outline data memory 10 stores therein the data for the outline L and the data for displaying the outline L. The unit pattern data memory 11 stores therein the data for stitching the unit pattern M and the data for displaying the unit pattern M.

The machine user therefore operates the outline selecting key 20 and a unit pattern selecting key 21 to select the outline L and the unit pattern M respectively, and subsequently operates a unit pattern number setting key 22 to set the number of a unit pattern M to be embroidered, and further operates a unit pattern size setting key 23 to set the size of the unit pattern M, and further operates a unit pattern space setting key 24 to optionally set the space between the unit patterns M. The size, number and space of the unit pattern may be predetermined with a standard value, but may be optionally varied.

The CPU 100 reads out an outline size deciding program from a memory 14 storing the program therein to decide the size, number and space of the unit pattern M and the size of the outline L which is a circle in this embodiment. Further the CPU 100 reads out a pattern arrangement adjusting program from a memory 13 storing the program therein to adjust the arrangement of the outline L and unit patterns M in accordance with the decided size of the outline L, the decided size and number of the unit pattern M and the decided space between the patterns M. The pattern data adjusted as such is stored in a temporary memory 51. Then the CPU 100 controls the machine motor drive circuit 110 and simultaneously reads out the pattern data stored in the temporary memory 51 to form the stitches in accordance with the pattern data.

Figure 4:
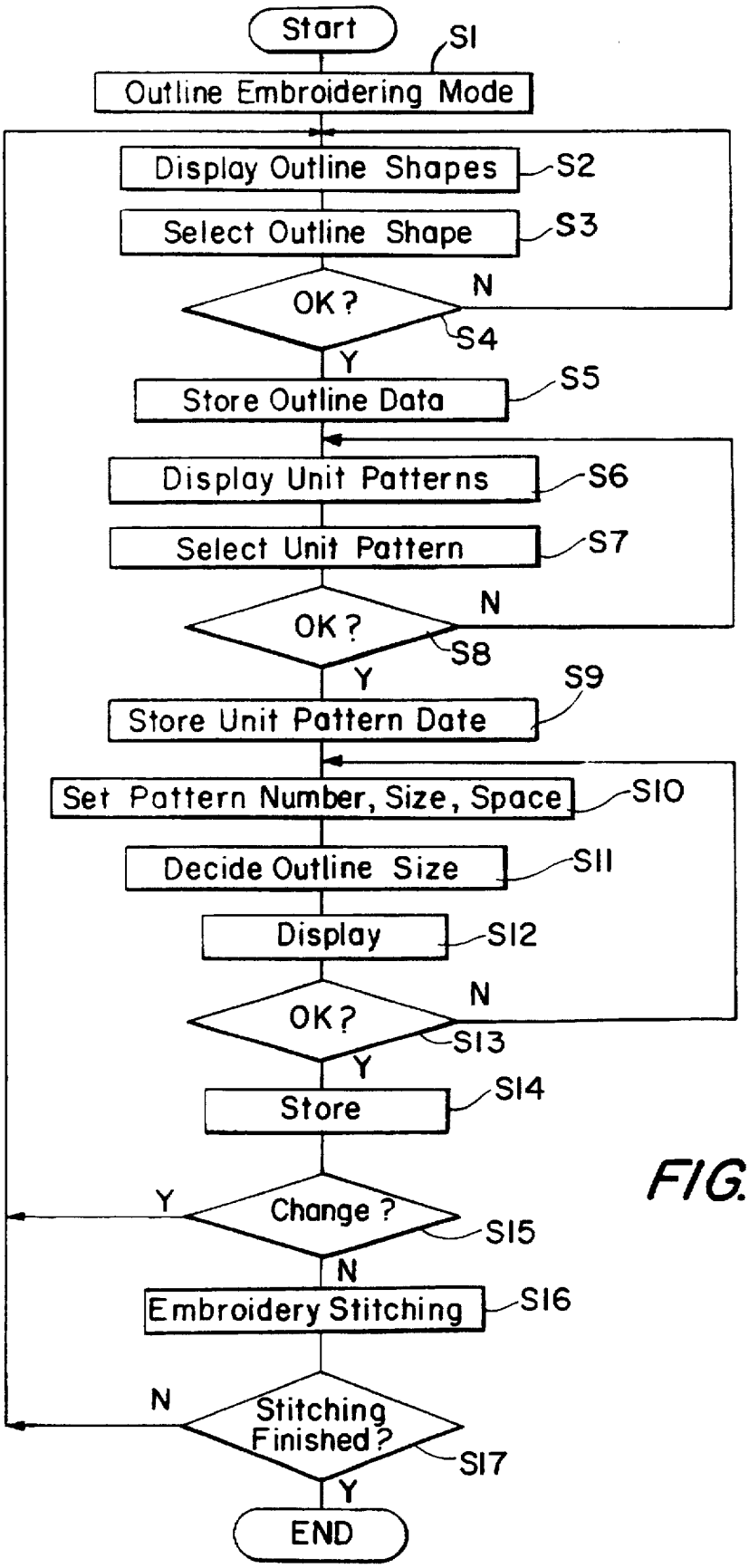
FIG. 4 is a flow chart showing the operation of the invention.

When the sewing machine is designed in accordance with the present invention as mentioned above, it operates as follows:

In reference to the flow chart as shown in FIG. 4, with manual operation of the mode selecting key 104, the sewing machine is rendered to the outline embroidering mode (step S1). The CPU 100 reads out the outline display data from the outline display data memory 10 and indicates a series of outline patterns in the display 106 as shown in FIG. 5(A) (step S2). With manual operation of the outline selecting key 20, one of the outline patterns is selected (step S3). The selection of the outline pattern is confirmed (step S4). Then the CPU operates to store the outline data in the temporary memory 51 (step S5).

Then the CPU 100 reads out the unit pattern data from the unit pattern data memory 11 and indicates a series of unit patterns in the display 106 as shown in FIG. 5(B)(step S6). With manual operation of the unit pattern selecting key 21, one of the unit patterns is selected (step S7). The selection of the unit pattern is confirmed (step S8). Then the CPU 100 operates to store the unit pattern data in the temporary memory 51 (step S9).

Then with manual operation of the unit pattern number setting key (22), the unit pattern size setting key (23) and the unit pattern space setting key (24), the number and the size of the unit pattern and the space between the unit patterns are set up respectively (step S10). The CPU 100 operates in response to the instructions given at the step S10 to decide the size of the outline pattern and adjustingly arranged the selected patterns as shown in FIG. 6 (step S11), and indicates the so arranged patterns in the display 106 (step S12). The arrangement of the patterns is confirmed (step S13). Then the CPU 100 stores the pattern data for the so arranged patterns in the temporary memory 51 (step S14).

Subsequently the CPU 100 asks the machine user in the display 106 if the so selected and arranged patterns are changed (step S15). If the change is made, the routine is returned to the step S2 and the subsequent steps are repeated. If no change is made, the sewing machine is operated to form the embroidery stitches in accordance with the pattern data stored in the temporary memory 51 (step S16).

Finally the CPU 100 asks the machine user in the display 106 if the stitching operation has been finished (step S17). If the stitching operation is not finished, the routine is returned to the step S2 and the subsequent steps are repeated. If the stitching operation has been finished, the routine comes to end.

It will be understood that each of the elements described above, or two or more together, may also find a useful application in other types of constructions differing from the types described above.

While the invention has been illustrated and described as embodied in sewing machine capable of embroidery stitching, and embroidery data producing device therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sewing machine capable of embroidery stitching, comprising first means for giving data for forming stitches of at least one unit pattern type to be embroidered; second means for giving data for representing a pattern arrangement configuration along which unit patterns of said at least one unit pattern type are arranged in series; third means for giving data for setting a size and a number of said unit patterns, a space between said unit patterns along, said pattern arrangement configuration, and a size of said pattern arrangement configuration; and stitching forming means operated under control of said given data to form the stitches of said unit patterns arranged along said pattern arrangement configuration.

2. A sewing machine as defined in claim 1, wherein said second means is formed so that the size and the number of said unit pattern, the space between said unit patterns in the arrangement of said unit pattern and the size of said pattern arrangement configuration are set in a predetermined priority sequence.

3. A sewing machine as defined in claim 1; and further comprising fourth means manually operated to set at least one of said size and said number of said unit pattern, said space between said unit patterns in the arrangement of said unit patterns and said size of said pattern arrangement configuration.

4. A sewing machine as defined in claim 3; and further comprising means other than at least one of said first, second and third means and giving data in a predetermined priority sequence.

5. A sewing machine as defined in claim 2; and further comprising fifth means manually operated to at least partly modify said predetermined priority sequence in which the size and the number of said pattern, the space between said unit patterns in the arrangement of said unit pattern and the size of said pattern arrangement configuration are set.

6. A sewing machine as defined in claim 5; and further comprising sixth means manually operated to set at least one of said size and said number of said unit pattern, said space between said unit pattern and said size of said pattern arrangement configuration.

7. A sewing machine as defined in claim 1, wherein said second means is formed so that said data for representing said configuration represents a linear outline forming a looped pattern.

8. A sewing machine as defined in claim 7, wherein said third means is formed so that said unit pattern is arranged in series on said linear outline, inside or outside of said linear outline.

9. A sewing machine as defined in claim 7, wherein said third means is formed so that said unit pattern is arranged in series along said linear outline, some of said unit patterns being on said linear outline, some of said unit patterns being inside of said line and some of said unit patterns being outside of said line.

10. A sewing machine as defined in claim 7; and further comprising ninth means manually operated to select locations of said patterns with respect to said line.

11. An embroidery data producing device for a sewing machine comprising:

first means for giving data for forming stitches of at least one unit pattern type to be embroidered;

second means for giving data for representing a pattern arrangement configuration along which unit patterns of said at least one unit pattern type are arranged in series;

third means for giving data for setting a size and a number of said unit patterns, a space between said unit patterns along said pattern arrangement configuration, and a size of said pattern arrangement configuration; and stitch forming means operated under control of said given data to form the stitches of said unit patterns along said pattern arrangement configuration.

12. A device as defined in claim 11, wherein said second means is formed so that the size and the number of said unit pattern, the space between said unit patterns in the arrangement of said unit pattern and the size of said pattern arrangement configuration are set in a predetermined priority sequence thereof.

13. A device as defined in claim 11; and further comprising fourth means manually operated to set at least one said size and said number of said unit pattern, said space between said unit patterns in the arrangement of said unit pattern and said size of said pattern arrangement configuration.

14. A device as defined in claim 12; and further comprising fifth means manually operated to at least party modify said predetermined priority sequence in which said size and said number of said unit pattern, said space between said unit patterns in the arrangement of said unit pattern and the size of said pattern arrangement configuration are set.

15. A device as defined in claim 14; and further comprising sixth means manually operated to set at least one of said size and said number of said unit pattern, said space between said unit patterns in the arrangement of said unit pattern and said size of said pattern arrangement configuration.

16. A device as defined in claim 11, wherein said second means is formed so that said data for representing said configuration represents a linear outline forming a looped pattern.

17. A device as defined in claim 16; and further comprising ninth means manually operated to select locations of said unit patterns with respect to said linear outline.

18. A sewing machine capable of embroidery stitching, comprising first means for giving data for forming stitches of at least one unit pattern to be embroidered; second means for giving data for representing a pattern arrangement configuration along which unit patterns of said at least one unit pattern type are arranged in series; third means for giving data for setting a size and a number of said unit patterns, a space between said unit patterns along said pattern arrangement configurations, and a size of said pattern arrangement configuration; and stitching forming means operated under control of said given data to form the stitches of said unit patterns arranged along said pattern arrangement configuration; means for providing more than one combination of said size and said number of said unit patterns, said space between said unit patterns in the arrangement of said unit pattern, and said size of said pattern arrangement configuration; and means manually operated to select one of said combinations.

19. An embroidery data producing device for a sewing machine comprising first means for giving data for forming stitches of at least one unit pattern type to be embroidered; second means for giving data for representing a pattern arrangement configuration along which unit patterns of said at least one unit pattern type are arranged in series; third means for giving data for setting a size and a number of said unit patterns, a space between said unit patterns along said pattern arrangement configuration, and a size of said pattern arrangement configuration; and stitching forming means operated under control of said given data to form the stitches of said unit patterns arranged along said pattern arrangement configuration; means for providing more than one combination of said size and said number of said unit patterns, said space between said unit patterns in the arrangement of said unit pattern and said size of said pattern arrangement configuration; and means manually operated to select one of said combinations.

* * * * *